United States Patent [19]

Andersson et al.

[11] Patent Number: 4,787,881

[45] Date of Patent: Nov. 29, 1988

[54] ARRANGEMENT FOR THE RAISING OF PACKING CONTAINER BLANKS

[75] Inventors: Roland Andersson, Malmö; Lars Carlsson, Blentarp; Anders Sjöström, Lund, all of Sweden

[73] Assignee: AB Tetra Pak, Lund, Sweden

[21] Appl. No.: 39,027

[22] Filed: Apr. 16, 1987

[30] Foreign Application Priority Data

Apr. 18, 1986 [SE] Sweden ..... 8601783

[51] Int. Cl.[4] ..... B31B 1/80

[52] U.S. Cl. ..... 493/316; 493/313; 493/317

[58] Field of Search ..... 493/313, 315, 316, 317; 53/564, 565

[56] References Cited

U.S. PATENT DOCUMENTS

| | | | |
|---|---|---|---|
| 2,782,695 | 2/1957 | Meissner et al. | 493/316 |
| 2,996,856 | 8/1961 | Price | 53/564 |
| 3,104,598 | 9/1963 | Davies | 493/313 |
| 3,367,248 | 2/1968 | Rhino et al. | 493/317 |
| 3,380,222 | 4/1968 | Bergmann et al. | 53/565 |
| 3,763,750 | 10/1973 | Reichert . | |
| 3,816,971 | 6/1974 | Reil | 53/160 |
| 4,348,853 | 9/1982 | Morse et al. . | |
| 4,493,687 | 1/1985 | Bernle | 493/310 |
| 4,573,957 | 3/1986 | Billberg | 493/309 |
| 4,651,509 | 3/1987 | Billberg et al. | 53/565 |

*Primary Examiner*—Frederick R. Schmidt
*Assistant Examiner*—Robert Showalter
*Attorney, Agent, or Firm*—Burns, Doane, Swecker & Mathis

[57] ABSTRACT

An arrangement for the raising and transferring flattened tubular packing container blanks (2) from a magazine (3) to a conveyor arrangement comprises suction elements (18*a* and 18*b*) arranged on arms (15) movable in a curved path away from each other. The placing of the elements is such that the suction elements in a certain position (receiving position) of the arms are directed towards each other so as to allow engagement with, and attachment to, two opposite sides of a flat blank.

2 Claims, 4 Drawing Sheets

ARRANGEMENT FOR THE RAISING OF PACKING CONTAINER BLANKS

FIELD OF THE INVENTION

The present invention relates to an arrangement for the raising of flattened, tubular container blanks with the help of a movable driving element, and, more particularly, to an arrangement in which the driving element is provided with suction elements for engagement with, and attachment to, the blanks.

BACKGROUND OF THE INVENTION

With the field of the packaging industry, where certain types of liquid contents, e.g. milk, are packed into consumer packages of the non-returnable type, packing machines are used, for example, which convert prefabricated packing container blanks into bottom-closed packing containers which subsequently are filled directly with the particular contents and closed. The packing container blanks are generally supplied to the machine in the form of flattened, tubular blanks which have to be raised before the conversion to individual packing containers, that is to say they must be converted to four-sided tubes of substantially square cross-sectional shape. This raising usually takes place in connection with the blank being transferred from a magazine at the inlet end of the packing machine to a first conversion station in the packing machine proper.

OBJECTS AND SUMMARY OF THE PRESENT INVENTION

It is an object of the present invention to provide an arrangement intended for the raising of flattened, tubular container blanks by means of which it is possible to provide a more reliable as well as quicker raising of the blanks than has previously been possible known arrangements of the type which comprises movable driving elements provided with suction elements.

This object has been achieved in accordance with the invention with the help of an arrangement of the type described above which has been given the characteristic that the driving element possesses oppositely directed suction elements so as to allow simultaneous engagement with opposite sides on a flattened container blank.

BRIEF DESCRIPTION OF THE DRAWINGS

In the following the invention will be described in more detail with the help of the attached drawings, wherein.

DETAILED DESCRIPTION OF A PREFERRED EMBODIMENT

Figure 1:
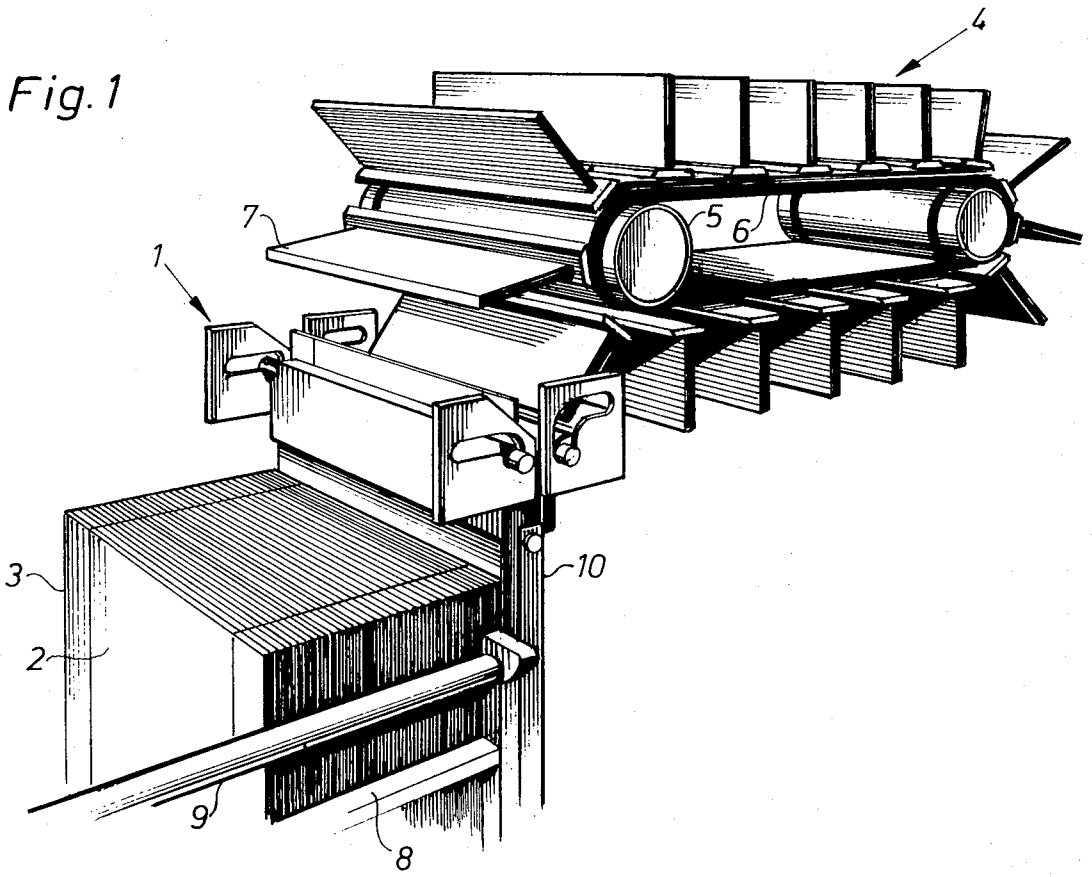
FIG. 1 is a perspective view of an arrangement in accordance with the invention for the transfer and raising of flattened, tubular packing container blanks from a magazine to a movable conveyor arrangement for the feeding of raised blanks into a packing machine.

In FIG. 1 is shown an arrangement 1 in accordance with the invention for the transfer and raising of flattened, tubular packing container blanks 2 from a magazine 3 to a conveyor arrangement 4 for the feeding of raised blanks into a packing machine, not shown, from which filled and closed packing containers are delivered. The conveyor arrangement 4 has its receiving end, located to the left in the Figure, placed substantially directly above the outlet end of the magazine 3 and comprises, for example, conveyor belts 6 driven around rollers 5 in the direction of feed, with drivers 7 arranged so that the space between the drivers corresponds to the shape of a raised container blank.

The magazine 3 is of elongated shape with a width corresponding to the length of the container blanks 2, and preferably is oriented so that its longitudinal direction is parallel with the direction of movement of the conveyor arrangement 4. The magazine 3, moreover, has a base plate 8 and longitudinal side supports 9 for the correct alignment of a stack of container blanks 2 lying compactly on the base plate 8. The stack of container blanks 2 lying in the magazine 3 is pressed continuously with a certain force against a driving plate 10 serving as an output device at the feeding-out end of the magazine, in order to ensure that one packing container blank 2 is ready at all times at the outlet end of the magazine for transfer to the conveyor arrangement 4. This action of the packing container blanks upon the outlet end of the magazine is not shown in the Figures, but may consist of some conventional arrangement, e.g. a pressure plate subjected to spring or weight action at the other end of the magazine.

The driving plate 10 serve as an output device at the outlet end of the magazine 3 and has a lateral surface substantially flush against the container blanks 2 with a slightly projecting edge 11, arranged parallel with the horizontal container blanks 2, whose height substantially corresponds to, or is slightly less than, the thickness of a flattened container blank 2. The driving plate 10 is connected at the bottom to a driving rod 12 driven by a motor (not shown), and at the top is joined to two connecting arms 14 in hinged connection with each other (at 13). Each of the connecting arms 14 is joined at the top to a substantially horizontal arm 15 whose length coincides with, or even slightly exceeds, the length of a container blank 2. The arms 15 are suspended with their ends in guide tracks 16 located right opposite each other on support plates 17 arranged at the ends of the arms. The arms 15 are provided, moreover, with suction elements 18 in the form of suction heads 18*a* and 18*b* respectively arranged along the arms which via connecting ducts 19*a* and 19*b* can be joined either to a common, or each to its own, vacuum source (not shown). It is important in this context in accordance with the invention that the connection of the suction elements to the vacuum source is such that the control of the respective suction heads 18*a* and 18*b* can be done irrespectively of each other.

The driving plate 10 is drivable with the help of the driving shaft 12 in a reciprocating vertical movement between a lower and an upper position which in the example shown corresponds to the projecting feed edge 11 on the driving plate 10 mentioned earlier being in its lower position directly below the bottom edge of the container blank 2 lying outermost in the magazine 3, while in the upper position the feed edge is level with, or just above, the top edge of the remaining container blanks. In the lower position so defined the arms 15 are in such a position that the suction heads 18*a* and 18*b* respectively find themselves directly opposite each other, while in the upper position, owing to the upward movement of the arms controlled away from each other along the tracks 16 in the support plates 17, the suction heads 18*a* and 18*b* are in a substantially horizontal, upward facing position.

Figure 2A:
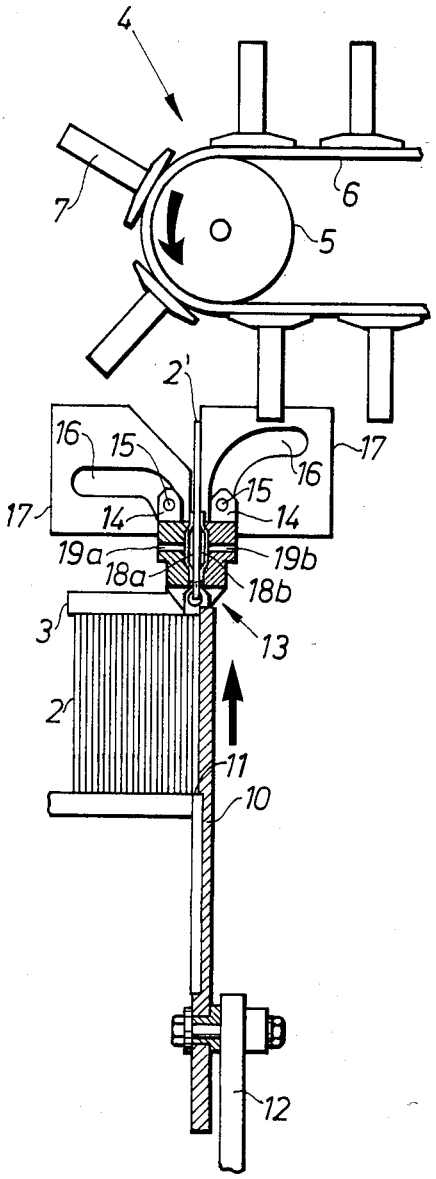
FIGS. 2*a*–2*d* are schematic views illustrating the principle of operation of the arrangement shown in FIG. 1.

In the following discussion the function of the arrangement shown will be described with reference to FIGS. 2*a*–2*d* which schematically illustrate the course of its function during a working cycle. In order to make this description clear, a brief description of a packing container blank will first be given with special reference to FIG. 3 which shows such a container blank in flattened condition to be raised to a shape of substantially square cross-sectional shape with the help of the aforesaid arrangement in accordance with the present invention.

The packing container blank 2, as mentioned earlier, is conventional and may be manufactured, for example, from a flexible but form-stable laminated material, e.g. a packing laminate which comprises layers of paper and plastics. After the laminate has been cut to the desired outer contour and provided with crease lines facilitating the fold-forming, two longitudinal edges are sealed together so that the laminate is converted to a tubular packing container blank. Subsequently, the packing container blank is flattened by folding it together along two longitudinal crease lines 201 and 202 whereby it acquires the flattened tubular shape shown in FIG. 3 with the side wall panels A–D delimited by the crease lines lying in parts against each other so that in the example shown the panels A and B adjoining the right-hand longitudinal crease line 201 and the panels C and D on the lefthand longitudinal crease line 202 respectively are situated straight opposite each other. A bundle of such flattened container blanks 2 are then arranged in a horizontal stack which in the present example means that the righthand edge line 201 will be facing downward while the lefthand edge line 202 consequently faces upward. This arrangement in the magazine 3, as shown in FIG. 2*a*–2*d*, may be assumed further to imply that the side of the packing container blanks 2 facing toward the outlet end of the magazine 3 is constituted of the panels A and D with panel A at the bottom, while the panels B and C are turned toward the other direction with the panel B at the bottom.

Figure 2B:
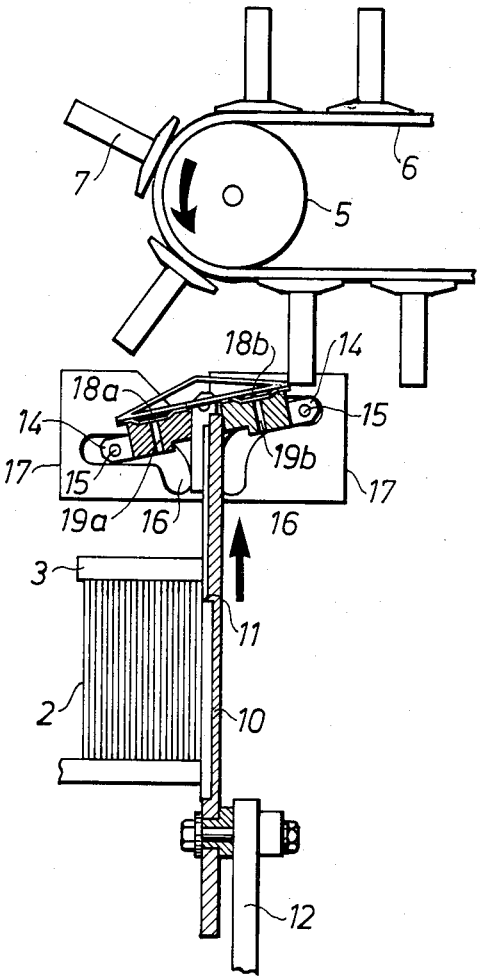
Figure 2C:
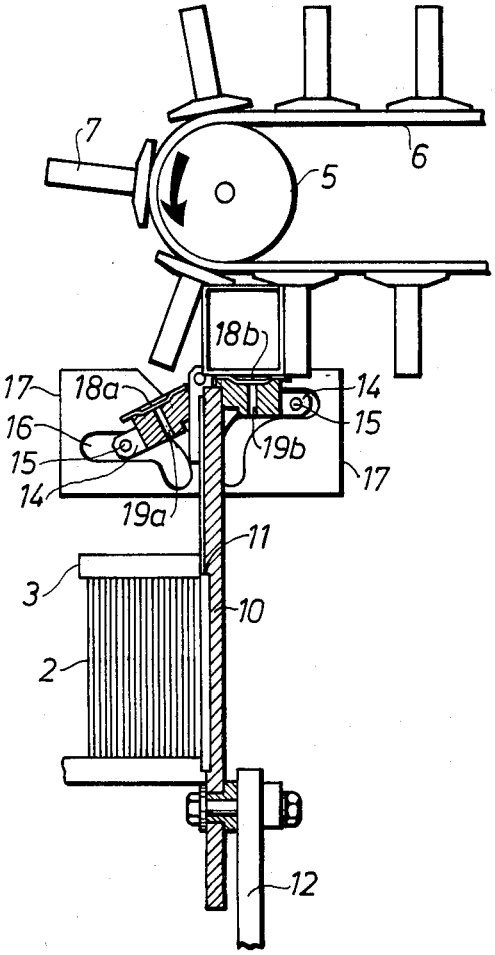
Figure 2D:
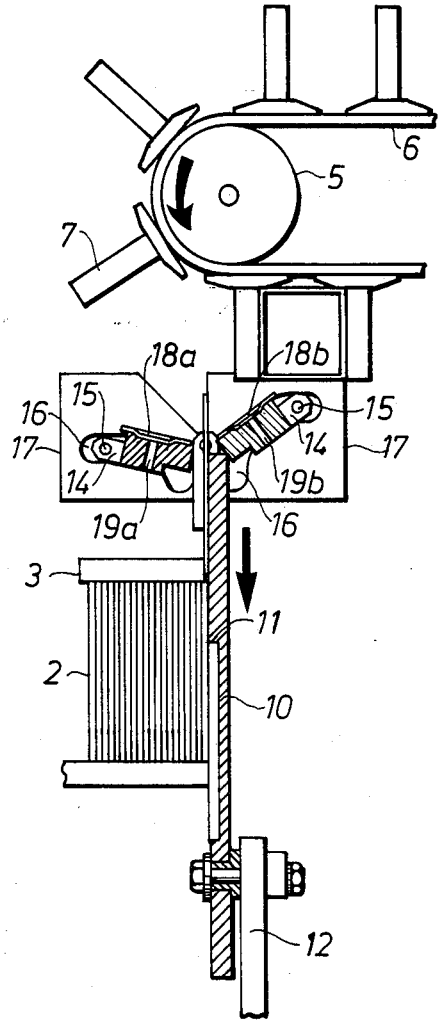
Figure 3:
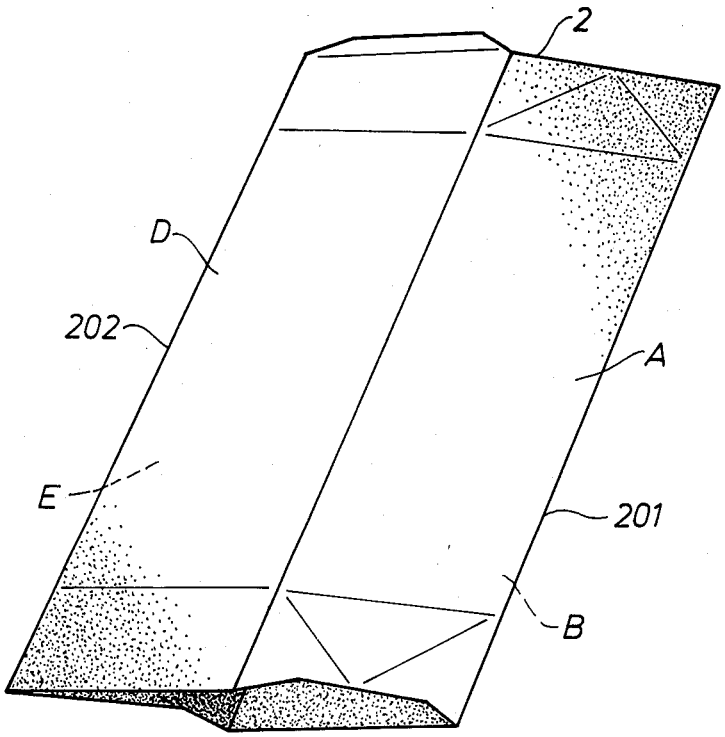
FIG. 3 is a perspective view of a conventional packing container blank in a flattened condition.

When the driving rod 12 and the driving plate 10 at the outlet end of the magazine 3 connected thereto move upward from the lower position defined earlier (as shown schematically in FIG. 2*a*), the projecting feed edge 11 on the driving plate 10 consequently will get hold of the container blank 2 lying outermost in the magazine 3 from underneath along the edge line 201 and move the same upward out of the magazine 3, as is evident from FIG. 2*b*, and further up to the position shown in FIG. 2*c* which corresponds to the upper position of the upward movement of the driving rod 12 and the driving plate 10 and which means, therefore, that the feed edge 11 will be at, or slightly above, the top edge of the magazine 3. Thereafter, the driving rod 12 turns and moves downward with the driving plate 10 back to the lower position shown in FIG. 2*a*, with the container blank 2 advanced left behind above the magazine 3 in a position ready for the actual raising operation. For the sake of clarity, it should be pointed out that this raising takes place simultaneously with the feeding out just described, on a container blank immediately preceding this one. Hence, with the help of the arrangement in accordance with the invention, on the one hand the feeding out, or rather the advance, of a flattened packing container blank to the ready position is taking place, while on the other hand a previously advance container blank is raised during one and the same working cycle.

A packing container blank which has been advanced to the ready position for raising is shown in FIG. 2*a* having the designation 2'. In this position, the blank lies between the arms 15 carrying suction heads in their lower position. These arms 15 have their respective suction heads 18*a* and 18*b* located directly opposite each other and level with, and aligned to, the side panels B and A respectively located at the bottom of the container blank 2'. The suction heads 18*a* and 18*b* are connected to the vacuum source, not shown, via the connections 19*a* and 19*b* respectively, so that a suction engagement with the said panels being achieved. During the enforced upward movement of the driving plate 10 and the interlinked connecting arms 14, the arms 15 which are controlled in guide tracks 16 of the support plates 17, will move in an upwardly directed path curved away from each other, as is evident from FIG. 2*b*. During this movement the container blank 2' is subjected to a raising or transfolding operation in that the suction heads 18*a* and 18*b* (which act upon the panels B and A respectively) separate the panels from each other by folding them in either direction outward from each other about the side edge 201 so that ultimately they are substantially in line with each other. This means at the same time that the two upper side panels C and D also are subjected to a corresponding folding out operation during which the two edge lines 201 and 202 are successively brought toward each other and pass an intermediate position wherein the previously flattened container blank 2' presents a square cross-section.

When the arms 15 have reached their upper position (FIG. 2*c*), the connection between the suction heads 18*a* and the vacuum source is broken, which means that the suction heads 18*a* release the grip on the side panel B and this in turn means that the "over-folded" container blank 2', owing to a naturally inherent propensity for refolding, tends to revert to, and assume, the original flattened condition. During this refolding, movement the container blank 2' thus passes again the previously over-folded intermediate position of square cross-section. By synchronizing beforehand the driving of the conveyor arrangement 4 located above the arrangement so, that a driver 7 passing by will just be in the right position for the refolding container blank 2' to strike against it with its edge line 202 at the very moment when the container blank has assumed its square cross-sectional shape, it becomes possible to catch the container blank in the raised intermediate position in the space between this and the immediately following driver, as is shown in FIG. 2*c*. After the container blank has been so caught the connection between the suction heads 18*b* and the vacuum source is also broken, as a result of which the grip on the side panel A of the container blank 2' is released and a feeding on of the container blank thus raised to square shape along the conveyor belt 6 is made possible. When this vacuum connection has been broken, the arms 15 together with the driving plate 10 and the driving rod 12 move downward (FIG. 2*d*) to revert to the lower position for new working cycles, that is to say the raising or the feeding out respectively of further container blanks.

While this invention has been illustrated and described in accordance with a preferred embodiment, it is recognized that variations and changes may be made and equivalents employed herein without departing from the invention as set forth in the claims.

What is claimed is:

1. An apparatus for raising flattened, tubular packing container blanks comprising:

a movable driving element having suction elements attachable to the blanks, said suction elements being formed by arms in hinged connection with each other which are movable away from each other and which are provided with suction heads that are directed toward one another in a first position of said driving element to allow attachment of the suction elements to two opposite sides of the flattened blank;

supporting plates on which said arms are suspended and which are provided with guiding tracks which are curved away from each other; and a driving plate which drives said arms and advances the flattened container blanks, said driving plate being arranged at an outlet end of a magazine for stacked, flattened container blanks, said driving plate including a feed edge projecting toward the container blanks, said feed edge being of a height corresponding to the thickness of a flattened container blank, said driving plate being movable between a lower position wherein said feed edge is directly beneath a longitudinal edge of an outermost container blank in the magazine and an upper position wherein said feed edge is at least as high as a top longitudinal edge of the container blanks in the magazine.

2. An apparatus in accordance with claim 1, wherein said suction elements are connectable to a vacuum source, and the apparatus further includes means for controlling the first of said suction elements independently of the second of said suction elements.

* * * * *